US007222835B2

(12) United States Patent
Martí-López

(10) Patent No.: US 7,222,835 B2
(45) Date of Patent: May 29, 2007

(54) FAST CONCRETE HOUSE SYSTEM FOR CONSTRUCTION OF HOUSES AND COMMERCIAL STRUCTURES

(76) Inventor: Reynaldo Martí-López, Calle 8, B-9, Urb. Aponte, Cayey, PR (US) 00736

( * ) Notice: Subject to any disclaimer, the term of this patent is extended or adjusted under 35 U.S.C. 154(b) by 0 days.

(21) Appl. No.: 10/869,714

(22) Filed: Jun. 16, 2004

(65) Prior Publication Data

US 2005/0280177 A1 Dec. 22, 2005

(51) Int. Cl.
*B28B 1/00* (2006.01)

(52) U.S. Cl. ..... 249/139; 249/156; 249/157; 249/166

(58) Field of Classification Search ..... 249/139, 249/156, 157, 161, 168; 264/232, 299

See application file for complete search history.

(56) References Cited

U.S. PATENT DOCUMENTS 3,853,452 A * 12/1974 Delmonte ..... 425/450.1
4,761,126 A * 8/1988 del Valle ..... 425/62
4,890,999 A * 1/1990 Del Monte ..... 425/439

FOREIGN PATENT DOCUMENTS

GB 2 026 932 * 2/1980

* cited by examiner

*Primary Examiner*—Donald Heckenberg
(74) *Attorney, Agent, or Firm*—Eugenio J. Torres

(57) ABSTRACT

A fast concrete house system for the construction of housing units is disclosed. The system disclosed herein allows for an improved low cost manufacturing, without the use of special tools or an ample array of structural elements.

10 Claims, 6 Drawing Sheets

FAST CONCRETE HOUSE SYSTEM FOR CONSTRUCTION OF HOUSES AND COMMERCIAL STRUCTURES

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

The present invention relates generally to prefabricated construction systems for the construction of housing and commercial structures and, more specifically, to a system for the fabrication of reinforced concrete structures using steel molds for the use in the construction of housing and commercial structures offering the user the ability to build a structure in-site at a low cost, in a short time, and with minimal equipment.

2. Discussion of the Background

The Twenty-First century provided humanity with mechanical machinery with great capacity that speed-up dramatically mass construction.

Present day masonry practices may be separated into three major groups as follows:

a. Confined masonry structures (concrete blocks placed in stack or interlocked and confined by reinforced concrete frames, said frames constructed in-site or prefabricated; the frames also may be constructed with other types of materials different from concrete).

b. Reinforced masonry structures (concrete blocks placed in stack or interlocked, forming a structural element by means of the placement of reinforcing steel in their cells and filling the same with concrete).

c. A hybrid of groups a and b.

However, all the aforesaid methods have not varied in decades and have several areas that could be improved. The construction of a reinforced concrete structure is very time consuming and costly. These construction systems are not mechanized and present several logistical problems. For instance, concrete roof slabs have to be molded at high elevations. In addition, concrete blocks continue being a fundamental element in the construction of concrete structures, which slows the construction process down. Concrete plastering continues to be one of the most problematic, costly and time consuming factors in construction.

There is a need for a System for Construction of Houses and Commercial Structures, which overcomes these and other deficiencies in the prior art.

The system of the invention belongs to the industrial technology sector of the production of construction materials and its application in the sector of construction of housing and edifications.

Concrete construction done by the conventional way cannot compare in time with the system of the invention. Generally, construction of a structure using the conventional way may last for as long as 150 days, while construction of a structure using the system of the invention may last for approximately 40 days. The following time table compares the time, in days, for completing a structure using the system of the invention and the conventional method:

| | DAYS TO COMPLETE TASKS | | | | | | | |
|---|---|---|---|---|---|---|---|---|
| | Footing | Floor | Walls | Roof | Concrete Curing | Concrete Plastering | Terminations. | Total Days |
| Conventional Method | 7 | 10 | 30 | 45 | 20 | 20 | 14 | 147 |
| System of the Invention | 7 | | | 21 | | | 14 | 42 |

One may notice the difference among the 42 days of the system of the invention and the 147 days of the conventional method. This can be done because all the structural pieces (walls and slabs) can be founded at the same time.

Therefore, it can be appreciated that there exists a continuing need for a new and improved system for the construction of houses and commercial structures. In this regard, the present invention substantially fulfills this need. The present invention overcomes the inability of the prior art to provide a system for the construction of houses and commercial structures that takes advantage of the technology developed to date in order to speed-up the construction process.

Various novel prefabricated construction systems have recently been disclosed, yet none provide a faster, cost efficient system of construction as the system of the present invention.

None of the existing art, taken either simply or in combination teach the use of L and T type molds and frames to construct concrete houses and structures.

II. SUMMARY OF THE INVENTION

The object of the present invention is to provide a system for the rapid and low-cost construction of reinforced concrete structures.

A further object of the present invention is to produce prefabricated walls, floors, and roofs of such weights and sizes that would allow transportation on the roads.

Still another object of the present invention is to create prefabricated pieces that allow the creation of structures in reinforced concrete, which comply with parameters established for this type of work.

Another object of the present invention is to allow the construction of an almost unlimited variety of houses and structures.

Still a further object of the present invention is to provide a structure that may easily be moved from its location.

Still another object of the present invention is to provide a structure with the latest technological advances such as an integrated computer system.

Another object of the present invention is to provide a structure that is as stable and secure as the conventional ones yet still constructed at a lower cost and in a much shorter time.

Another object of the present invention is to provide a system that allows the possibility of constructing additional floors to the structure.

Still a further object of the present invention is to provide a system that allows the construction of all sorts of concrete structures such as urbanizations, townhouses, multi-floors and commercial structures as well as individual houses.

It is another object of the present invention to provide a system which enables the rapid erection of a building or structure which can be assembled on site using minimal skills.

The system itself, both as to its construction and its mode of operation will be best understood and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more than one patentably and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

III BRIEF DESCRIPTION OF THE DRAWINGS

The use of the same numerals in the different views of the drawings shall be a reference to the same structures, parts, or elements, as the case may be.

IV DESCRIPTION OF THE PREFERRED EMBODIMENT

The production system consists of steel molds that are open and closed on steel frames for the construction of "L-type" and "T-type" structural walls, which may be transported internally in an assembly plant with a wall moving car.

The purpose of the wall moving car is for carrying the cast walls after initial curing out of the mold area, then to the painting area, then to the wiring area, and finally to the area of transportation to the location of the project. With this the concrete casting mold will be free sooner for another wall casting.

In the preferred embodiment, all the parts of the system (molds, frames, and wall moving cars) are made of steel or another strong suitable material.

At least three steel plates and a hook and lock setup is disclosed (FIG. 7) for securely lifting the concrete structural elements and fixing them together by welding on the site. When transporting them, these lifting plates with the hook and lock setup also serve for tying the structural elements for stability and security.

The simple fact that three points compose a plane and that all L and T structural walls have three joining points on each upper and lower plane leads to the conclusion that the structure is stable.

Figure 2:
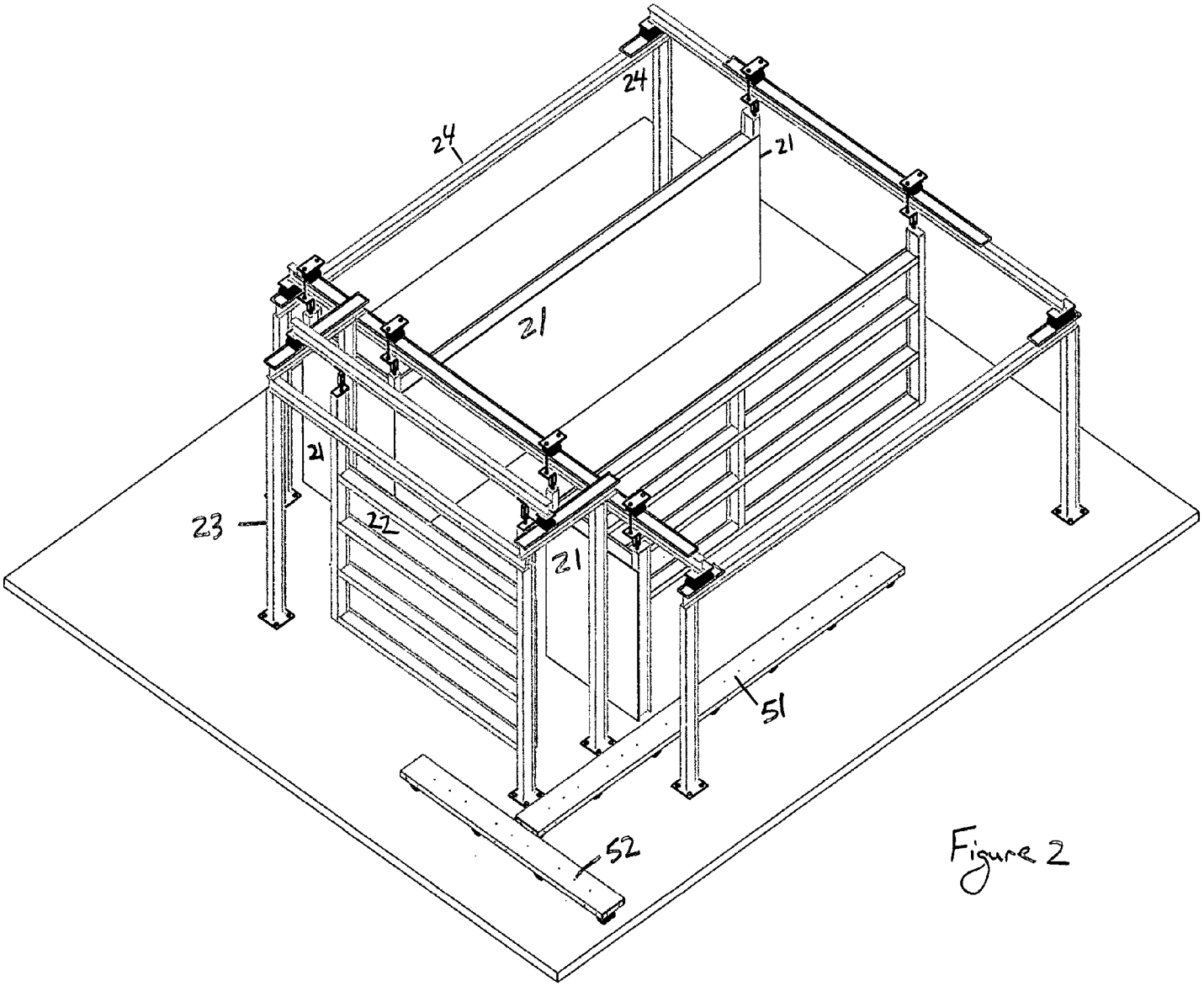
FIG. 2 is a view of a T1 Mold, Frame and Wall Moving Car.
Figure 3:
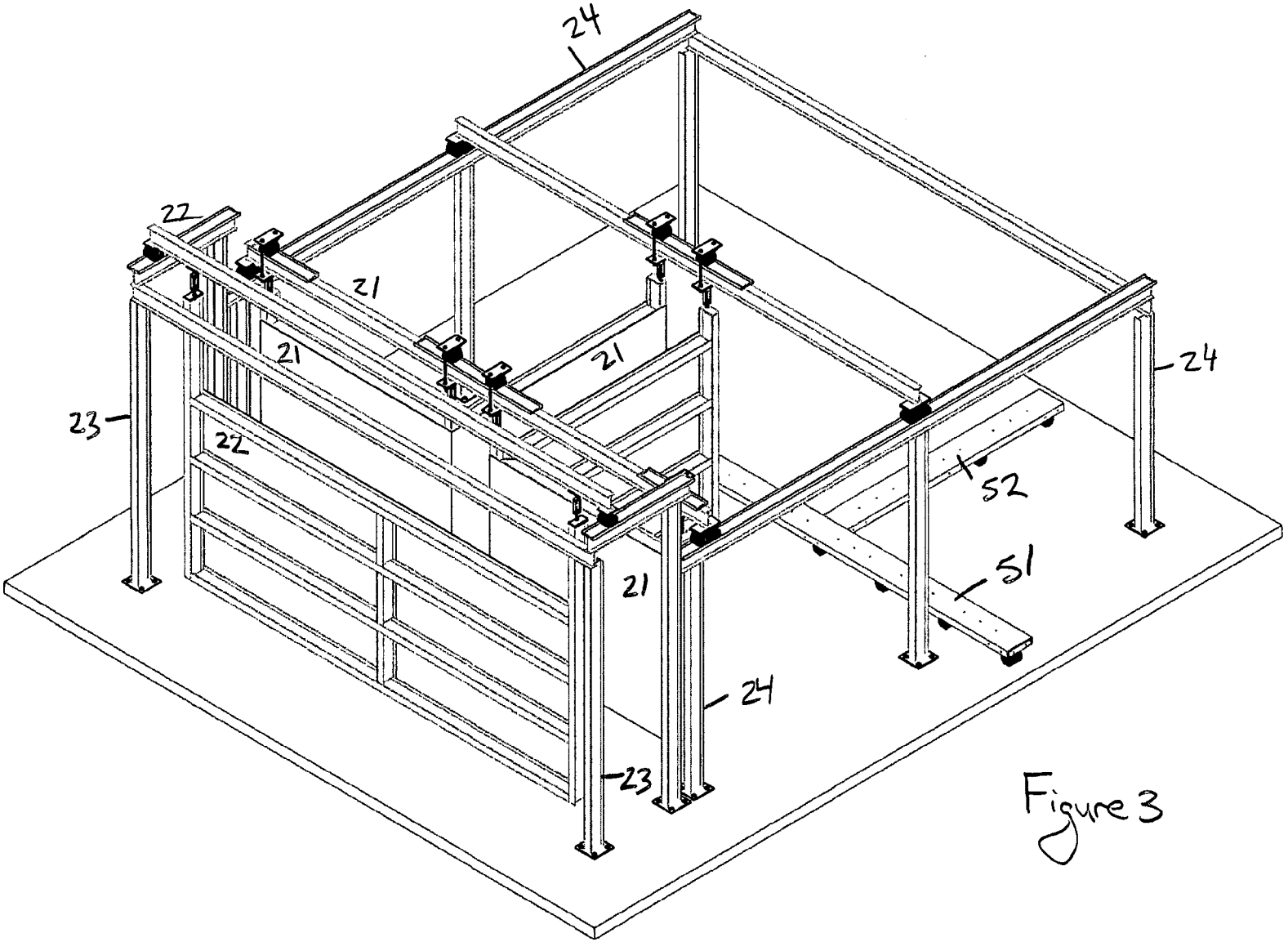
FIG. 3 is a view of a T2 Mold, Frame and Wall Moving Car.

The system of the invention comprises at least two different kinds of molds of controllable variable length and thickness for wall concrete placement. Said molds are for the construction of "L" and "T" type structural walls. There are several possible embodiments for the aforementioned molds. For instance: L Right (FIG. 1), L Left, L Small, T1 (FIG. 2), T2 (FIG. 3), and T Small Molds. In the preferred embodiment, these molds are all made with a steel section W 8×10 elements and square tubes having approximate measurements of four inches times four inches times one fourth of an inch (4"×4"×¼") at the corners welded to an approximately one fourth inch times eight feet high steel plate (¼"×8'). In other embodiments, the molds may be of different materials and measurements.

In the preferred embodiment, the molds sections hang on at least two 6,000 pound capacity Albion Heavy Duty V-Grooved Caster, 94 Series-Rigid Plate, six inches (6") diameter wheels (3G254) over a C7×9.8 track channel welded to a W 8×10 steel beam. These wheels have a 1'0"×6"×½" steel plate welded on top with two Hex Head High Strength Zinc Cremate Steel Cap Screw 1'9" long and /1;2" diameter, Coarse Thread holding another 1'0"×6"×/1;2" steel plate. This second plate has at its center one Drop Forged Steel Turnbuckle/1;2"×12" (2997T56) with two Hex Head High Strength Zinc Cremate Steel Cap Screw 6/1;4" long and /1;2" diameter. The bottom screw holds the steel plate that will be welded to the top of the molds steel vertical edge's element.

In addition to the six (6) types of molds that, in the preferred embodiment weight approximately fourteen thousands pounds (14,000#) each, the system requires frames, made of steel in the preferred embodiment, for their mobility. These are made of a steel section W 8×10 elements and steel channels C 7×9.8. In the preferred embodiment, the frames are fixed to the floor with a twelve inches by twelve inches by one half of an inch (12"×12"×½") steel plate on each leg fixed to the concrete floor with four bolds. These frames will facilitate the closing and opening of the molds for work. In the preferred embodiment, there are six different frames, one for each mold.

Figure 5:
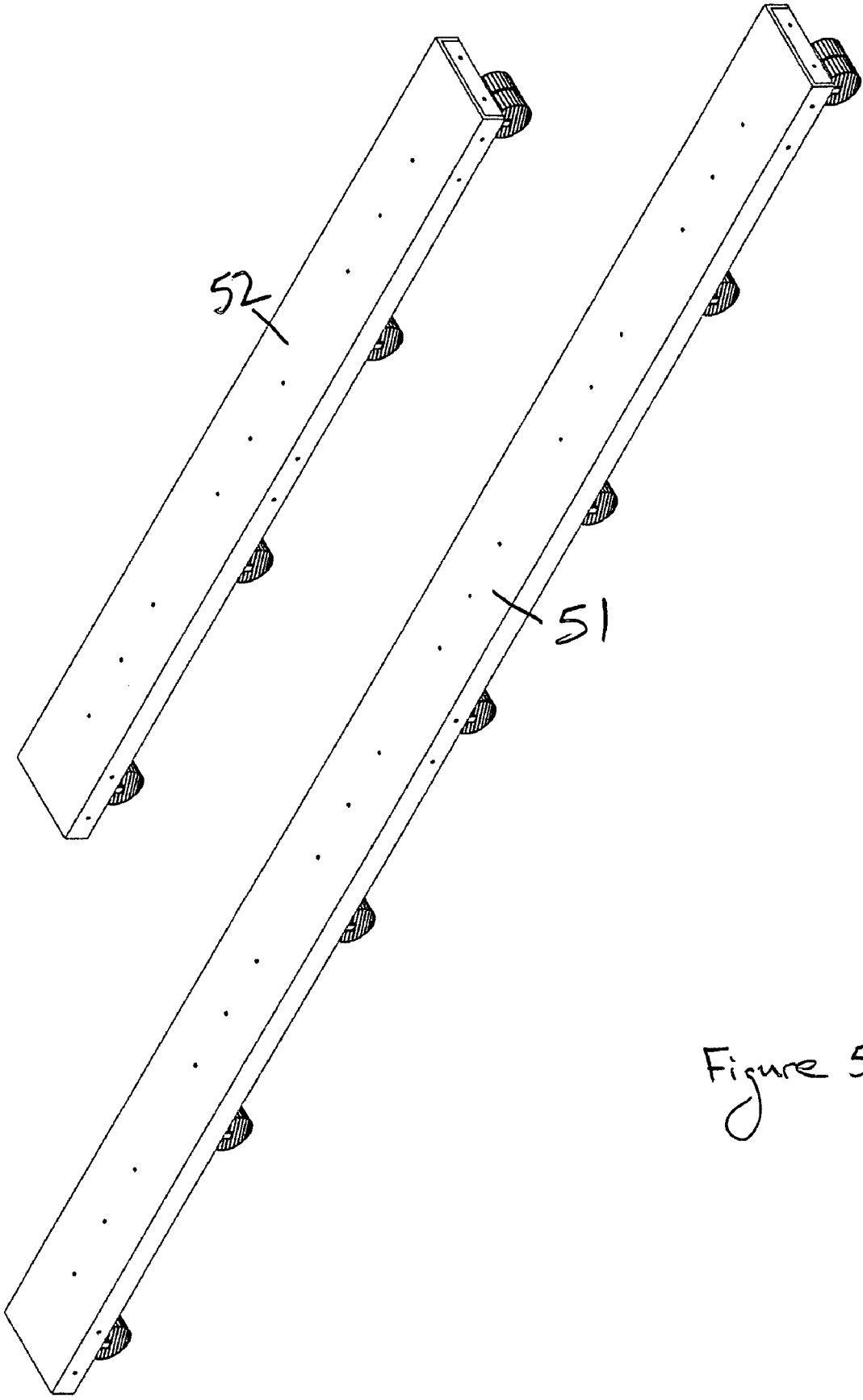
FIG. 5 is a view of the two parts of the Wall Moving Cars.
Figure 6:
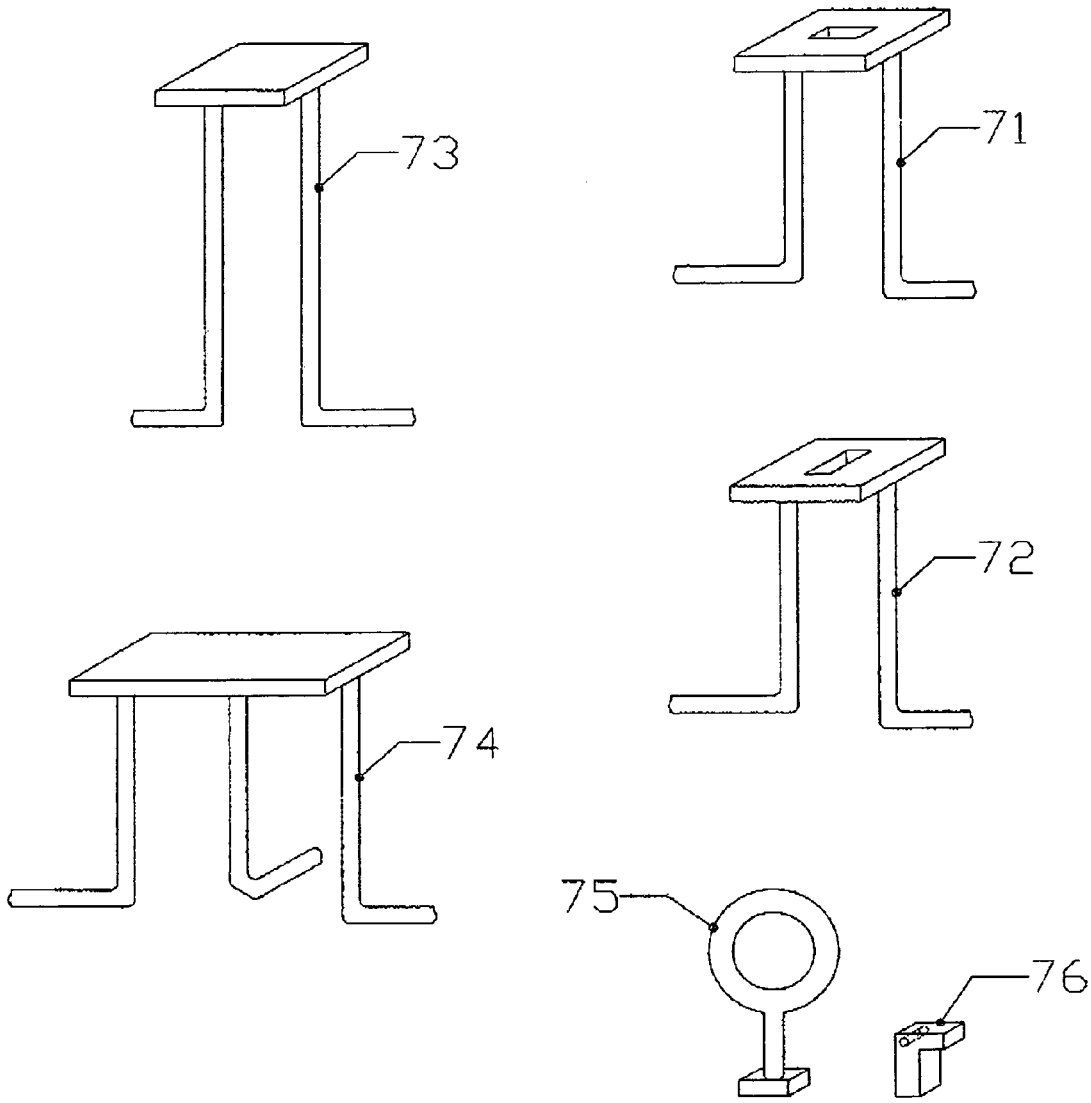
FIG. 6 is a view of the small, double, and upper steel lifting hook and hook lock.

The system of the invention further comprises a wall moving car for each mold (FIG. 5) for the mobilization of the walls. In the preferred embodiment, these are made of two steel channels with Albion Heavy Duty V-Grooved Casters, 94 Series-Swivel Plate, six inches (6") diameter (3G255). In the preferred embodiment, the two channels are one twenty feet long with seven wheels 51, and the other an eleven feet long channel with four wheels 52. The wheels are Casters Albion Heavy-Duty V-Grooved, 94 Series-Swivel Plate, six inches (6") diameter (3G255). These channels comprise a ½" steel plate welded at the ends with two ⅝" holes for two screws or a pulling hook. The channels further comprise, on each extreme side and on each side at the center two ⅝" holes for two screws or a pulling hook. Combining these two channels all wall moving cars of the preferred embodiment can be done. In the preferred embodiment, the channels also have, at the top, between each wheel three ⅝" holes for a screw for the wall closing channel. These wall moving cars will move the walls after initial curing out of the mold areas at a speed as slow as ten feet per hour in the preferred embodiment.

V Molds, Frame, Wall Moving Car

The characteristics of the preferred embodiment of the invention are described as follows:

1. L Right (LR) (FIG. 1)
   A. Mold—In the preferred embodiment, this mold 11 may produce walls up to twenty feet (20'0") long with a maximum ten feet (10'0") arm on the right end. Each mold comrpises six (6) Albion Heavy Duty V-Grooved Casters. In the preferred embodiment, this mold's weight is approximately 12,932 pounds.
   B. Frame—In addition, the mold requires a frame 12, made of steel in the preferred embodiment, for their mobility. This frame can open and close the L Right mold. Two sets of molds can be managed on each frame. In the preferred embodiment, the weight of this frame is approximately 2,546 pounds.
   C. Wall Moving Car—This wall moving car 13 is designed with: One channel of eleven feet long (11'0") and another of twenty feet (20'0"). The eleven feet long channel is screwed at the end of the twenty feet long channel to the right with two ⅝" diameter screws and pressure clamps. In the preferred embodiment, the car supports approximately sixty-six thousand pounds.
2. L Left (LL) same as L Right except that the ten feet (10'0") arm is to the left end.
3. Type L Small—Since the most required walls are small walls, a small L mold is created. This mold can produce walls ten feet (10'0") long with a maximum ten feet (10'0") arm. This mold is for smaller walls that cannot be classified as either L Right or L Left. All the sections are adjusted to these sizes. This mold is the same as L Right except that the 20 feet axis is reduce to 10 feet.

Figure 1:
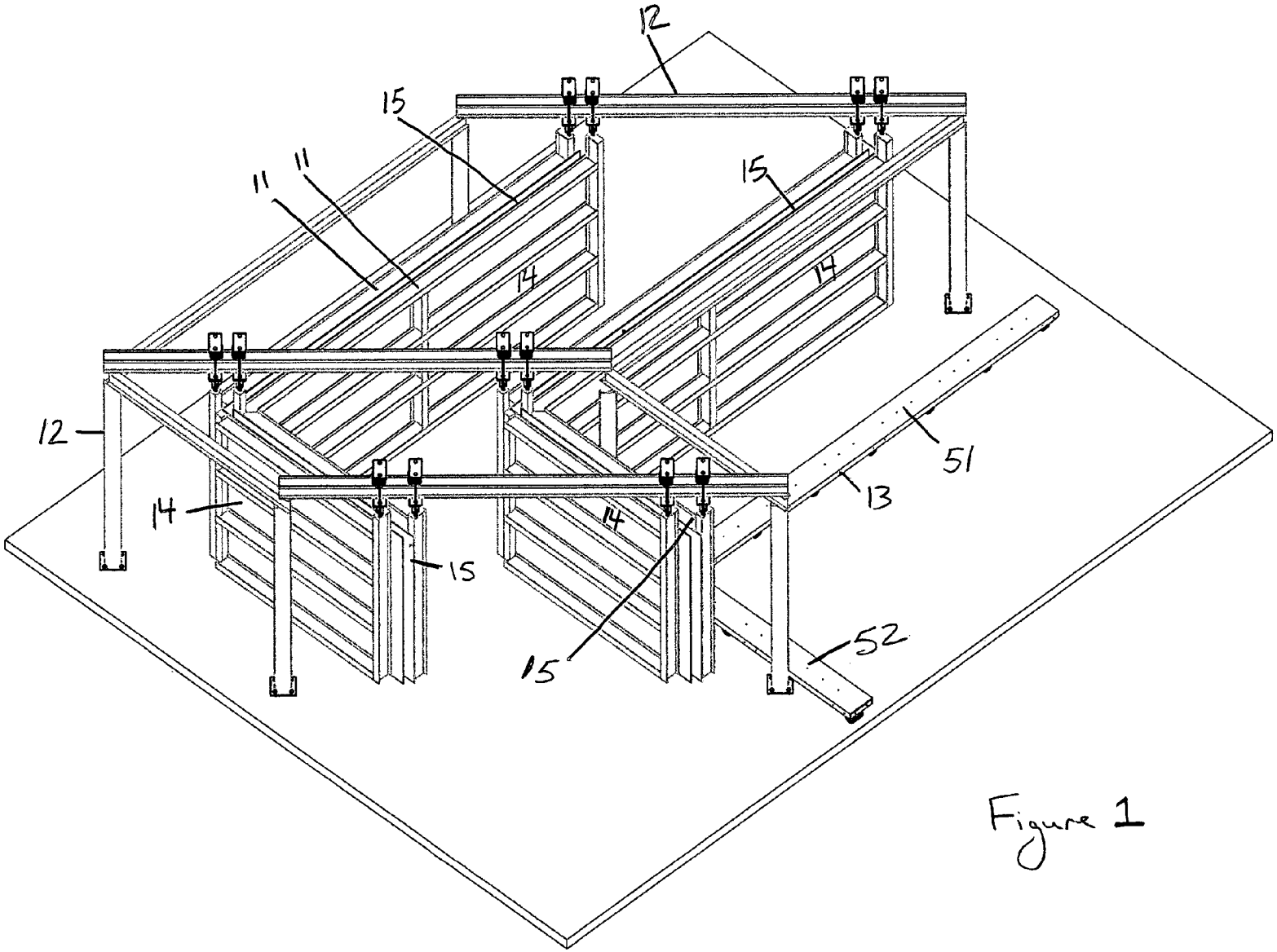
FIG. 1 is a view of an L Right Mold, Frame and Wall Moving Car.
Figure 4:
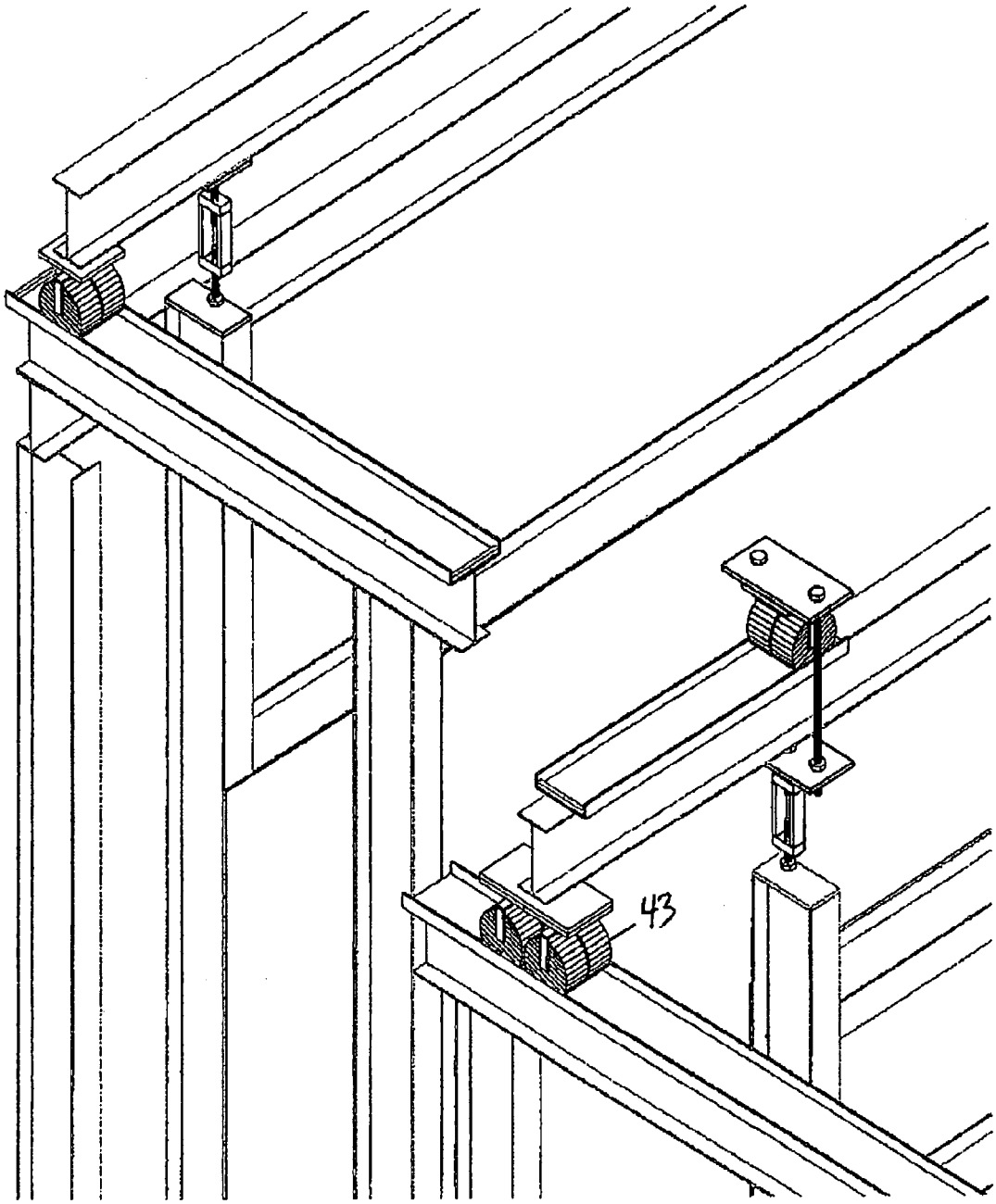
FIG. 4 is a view of the Mold Moving Wheels.

In the preferred embodiment, these three "L" molds are composed of two sets of steel plates welded together in L form to the W 8×10. The outer mold (FIG. 1, 14) has three 4"×4"×1;4" square tubes welded at the corners and the inner mold has one (FIG. 1, 15). In the preferred embodiment, each mold hangs on the three edges on Albion wheels (FIG. 4, 43), wherein said wheels comprise Drop Forged Steel Turnbuckles which may be used to lift or lower the molds when necessary and which wheels run on the channels that serve as tracks over the steel frames.

4. Type T1 (FIG. 2)
   A. Mold—In the preferred embodiment, this T1-shaped mold can produce walls twenty feet (20'0") long with a five feet (5'0") panel on each side up to a maximum of ten feet (10'0"). This mold can produce L walls just by closing the edge with a closing element next to the corner of the L steel wall of the mold. Each mold contains sixteen (16) Albion Heavy Duty V-Grooved Casters. In the preferred embodiment, this mold's weight is approximately 15,524 pounds.
   B. Frame—This frame can open and close the T1 mold. In the preferred embodiment, the weight of this frame is approximately 3,523 pounds.
   C. Wall Moving Car—In the preferred embodiment, this wall car is designed with: one eleven feet long (11'0") channel and a twenty feet (20'0") long channel. The eleven feet long channel is screwed at the top towards the center of the twenty feet long with two ⅝" diameter screws and pressure clamps. The car supports approximately sixty-six thousand pounds.
5. Type T2 (FIG. 3)
   A. Mold—In the preferred embodiment, this T2-shaped mold can produce walls twenty feet (20'0") long with an up to ten feet (10'0") panel in the middle. This mold can produce L walls just by closing the edge with a wall closing element next to the corner of the L steel wall of the mold. Each mold comprises fourteen (14) Albion Heavy Duty V-Grooved Casters. In the preferred embodiment, this mold's weight is approximately 14,000 pounds.
   B. Frame—This frame can open and close the T2 mold. In the preferred embodiment, the weight of this frame is approximately 2,749 pounds.
   C. Wall Moving Car—This wall car is designed with: one eleven feet long (11'0") channel and a twenty feet (20'0") long channel. The twenty feet long channel is screwed at the top towards the center of the eleven feet long channel with two ⅝" diameter screws and pressure clamps. The car supports approximately sixty-six thousand pounds.
6. Type T Small—In the preferred embodiment, the type T-Small Mold is the same as a T1 mold reducing the long axis to ten feet.

These three T-type molds comprise one set of steel plates welded together to the W 8×10 to form a straight edge. These T frames are composed of two parts. The small-high frame (23) is for moving the straight edge of the T molds (21). The big-low frame (24) is for moving the two L type molds (22) in, out and laterally. The frames comprise channels that serve as tracks for the wheels that support the molds.

On T1 molds (FIG. 2) this straight edge is ten feet six inches (10'6") and on T2 (FIG. 3) it is twenty feet (20'0"). These molds' edges hang on a W8×10 which is moved independently in and out on two Albion wheels (FIG. 4, 43) over the channels that serve as tracks on the small-high steel frames (24).

VI Wall Closing Elements (FIG. 7)

The thickness of the walls on all molds is controlled by wall closing elements at the ends of the walls which screw on to the top of the wall moving cars.

In the preferred embodiment, the wall closing elements are the following: for a four inches (4") wall; C 4×5.4 channel, for a five inches (5") wall; C 5×6.7 channel, for a six inches (6") wall; C 6×8.2 channel, for a seven inches (7") wall; C 7×9.8 channel, for an eight inches (8") wall; C 8×11.5 channel. In the preferred embodiment, each channel has a steel plate ¼"×2"×(the thickness of the wall plus 4 inches) Other wall thicknesses are possible.

In the preferred embodiment, the wall closing elements contain a removable high strength zinc chromate steel screw threaded reinforced with six inches (6") long channels at the bottom of the channel which screws on with an ⅝" bolt and pressure clamp to the top of the wall moving car. With this the length and thickness of the walls is controlled.

VII Connecting Steel Plates (FIG. 7)

In order to move and to fix the different L's and T's walls with the floor slab and roof slab, the preferred embodiment includes three steel plates (71, 72, 73, 74). These plates are designed for carrying the concrete walls and slabs to the project as well as for welding the structural elements between them. These may be strategically located as to get the most effective structural stability.

One plate, the upper plate 71 or 72, is for lifting and moving the cured concrete structural pieces. The other two 73 and 74 are just for fixing the pieces together. In the preferred embodiment, the plates are 3 inches times 4 inches times ½ inch. Two #4 steel rods 12 inch long are welded to the plate. These rods are bent and tied to the structural steel rods of the walls, floor and roof slabs. The rods can also be bent so as to accommodate any situation. The other steel plate is 3 inches times 8 inches times ½ inch with three #4 steel rods welded and will be used when two plates must be welded together to a third plate.

The Upper Steel Plate has a ¾ inch times 1½ inch rectangular hole at the center for lifting the structural elements. A reusable lifting hook (75) preferably ¾ inch in diameter and a reusable lifting hook lock (76) for safety may be used to lift the structural elements. The idea is to paste a 1½ inch diameter times ½ of foam on the hole of the Upper Steel Plate so that after the concrete is cured it will be removed with a small amount of solvent.

All walls have three at the top end and all slabs will have four Upper Steel Plates. On the slabs they will be placed at ¼ the length of the long axis on the top of the beam so as to balance the weight.

For moving the structural elements the reusable lifting hook may be inserted on the Upper Steel Plate and half turned. Then the Reusable Lifting Hook's Lock may be inserted. This will not permit the hook to turn. Now they can be lifted by the hooks.

After the walls and slabs have been prepared and the plates have been placed concrete may be poured. Once the concrete is cured then the concrete structural pieces (L's and T's walls and floor and roof slabs) may be taken to the project and be installed using a welding machine to fix them together. At least two steel plates in combination may be used on each joint.

VIII Production and Construction System

A. Walls Production System

1. The wall car is placed under an L section part of the mold. The steel rods will be placed and tied according to the structural plans.
2. The bottom and upper steel plates will be placed and tied.
3. The wall closing channel is placed, screwed and adjusted.
4. The molds will be oiled, closed and tied.
5. Concrete is poured continuously with concrete electrical vibrators to avoid air spaces.
6. The molds are opened after initial curing (approximately eight hours) by turning the drop forged steel turnbuckles.
7. The wall car with the wall is pulled out very slowly out of the mold area.
8. After secondary curing the wall will be moved to the export area for final curing (at least three weeks).
9. Walls are transported to the project area for installation.

B. Floors and Roof Slabs Production System.

1. A steel mold of the slabs size is prepared.
2. The walls may be drawn with crayons inside the steel mold.
3. The steel rods are placed and tied according to the slabs structural plans.
4. The bottom and upper steel plates are placed and tied.
5. Concrete is poured with concrete electrical vibrators continuously to avoid air spaces.
6. After initial curing (approximately six hours) the molds are opened and removed.
7. They are left curing for 28 days.

C. Concrete Structures Construction System

1. The survey crew marks the footings on the field.
2. The foundations are made on the site and designed to meet site soil conditions.

Two cases arise:

Case I: Footings non dependent of floor slabs. This is the most critical, costly, and labor intensive case.
   - a. The footing crew makes the footings excavations and installs the steel bars and steel plates.
   - b. Concrete is poured. The next day the molds are removed.
   - c. They are left curing for at least three weeks.

Case II: Footings monolithic with floor slabs. This is the most economical footing.
   - a. The footing crew makes the excavations and installs the steel bars and steel plates of the floor slabs.
   - b. Concrete is poured. The next day the molds are removed.
   - c. They are left curing for at least three weeks.
3. During the construction of the foundations, and while this concrete is being cured, the structure will be cast, cured, painted and partially wired at the same time in the plant. Different from conventional methods, all the parts are made at the same time (three weeks).
4. After the parts have been cast and cured {the concrete of the foundations (in the site) and all the structural pieces (in the plant)} the walls, the floors (for Case I) and roofs slabs are transported for installation with a crane and a welding machine. This can be done practically anywhere. This installation labor will take one day.

The installation will be done in the following way:

Case I: Footings Non-Depended of Floor Slabs.

- a. The floor slabs are placed over the footings welding its plates with the inferior plates of the slabs.
- b. The structural walls are placed over the floor slabs welding the upper plate of the floors with the inferior plates of the walls and welding the walls between them.
- c. The Upper Steel Plates between slabs are welded.
- d. The empty space of The Upper Steel Plates is filled with foam.
- e. The inch over The Upper Steel Plates is filled with concrete plaster.

Case II: Footings Monolithic and Non-Depended with Floor Slabs.

- a. The structural walls are placed over the floor slabs welding the upper plate of the floors with the inferior plates of the walls and welding the walls between them.
- b. Roofs slabs are placed over the structural walls and welded.
- c. The Upper Steel Plates between slabs are welded.
- d. The empty space of The Upper Steel Plates is filled with foam.
- e. The inch over The Upper Steel Plates is filled with concrete plaster.

5. After the mounting of the roofs slabs the roof sealer brigade will come to the site (one day).
6. The finishing of the work will be carried out by finishing brigades that will be in charge of the installation of doors, floor tiles, glazed tiles, kitchen cabinets, windows, utilities and the sealing of the roof slabs. This labor will take approximately two to three weeks).

Thus, there has been shown and described a fast concrete house system for construction of houses and commercial structures which fulfills all the objects and advantages sought therefor. The invention is not limited to the precise configuration described above. While the invention has been described as having a preferred design, it is understood that many changes, modifications, variations and other uses and applications of the subject invention will, however, become apparent to those skilled in the art without materially departing from the novel teaching and advantages of this invention after considering this specification together with the accompanying drawings. For example, the particular shapes and proportions of the elements of the invention may be varied as desired. Accordingly, all such changes, modifications, variations and other uses and applications which do not depart from the spirit and scope of the invention are deemed to be covered by this invention as defined in the following claims.

All of the patents recited herein, and in the Declaration attached hereto, if any, are hereby incorporated by reference as if set forth in their entirety herein. The details in such patents may be considered to be incorporable at applicant's option, into the claims during prosecution as further limitations in the claims to patentably distinguish any amended claims from any applied prior art. The components disclosed in the various patents, patent applications, and publications, disclosed or incorporated by reference herein may be used in the embodiments of the present invention, as well as equivalents thereof.

All, or substantially all, of the components and methods of the various embodiments may be used with at least one embodiment or all of the embodiments, if more than one embodiment is described herein.

The details in the patents, patent applications, and publications may be considered to be incorporable at applicant's option, into the claims during prosecution as further limitations in the claims to patentably distinguish any amended claims from any applied prior art.

In the claims, means-plus-function clauses, if any, are intended to cover the structures described herein as performing the recited function and not only structural equivalents but also equivalent structures.

What is claimed is:

1. A concrete structure production system comprising:

a. at least two different kinds of molds of variable length and thickness for wall concrete placement for the construction of "L" and "T" type structural walls each of said molds having a top and a bottom part, said top part comprising wheels which support the molds and a locking system, wherein at least one of said molds is an "L" type mold and at least one of said molds is a "T" type mold;

b. at least two different kinds of wall moving cars to move said "L" and "T" type structural walls;

c. wall closing elements for controlling the thickness of said "L" and "T" type structural walls, said wall closing elements having at least one removable hooking system to connect to said wall moving cars;

d. at least two different kinds of frames having channels tat serve as tacks for wheels supporting the molds, wherein at least one of said frames is a "T" type frame and at least one of said frames is an "L" type frame;

e. means for fixing said frames to the ground:

f. said wall moving cars having at least two second channels said of these second channels having a plate welded at the ends with two holes for two screws or a pulling hook and two holes on each side for two screws or a pulling hook;

g an upper plate having a hole at the center for lifting and moving said structural walls;

h. at least two plates for fixing the structural walls together;

i. a hook and lock setup for securely lifting and fixing together said structural walls; and j. wherein said molds, frames, wall moving cars, and plates are all made of a strong suitable material.

2. The system of claim 1, wherein said strong suitable material is steel.

3. The system of claim 2, wherein said steel molds are open and closed on said steel frames for the construction of "L-type" and "T-type" structural walls.

4. The system of claim 3, wherein the T frames comprise a small-high frame for moving the straight edge of the T molds, and a big-low frame for moving the L-type molds in, out, and laterally.

5. The system of claim 1, wherein the thickness of the structural walls on all molds is controlled by said wall closing elements which screws on to the top of said wall moving cars.

6. The system of claim 5, wherein said L molds comprise two sets of steel plates welded together in L form.

7. The system of claim 6, wherein said L molds bang on the three edges on said wheels, said wheels having drop forged turnbuckles, said turnbuckles being disposed to lift or lower the L molds when necessary, and wherein said turnbuckles run on the channels that serve as tracks over the frames.

8. The system of claim 7, wherein, said T molds comprise one set of steel plates welded together to form a straight edge.

9. The system of claim 5, wherein said T molds' edges hang on a W8×10 which will be moved on said wheels over the channels that serves as tracks on said frames.

10. The system of claim 4, wherein said steel molds are transported with said wall moving cars.

* * * * *